United States Patent [19]

Eremin et al.

[11] Patent Number: 4,793,917

[45] Date of Patent: Dec. 27, 1988

[54] CENTRIFUGAL CLASSIFIER FOR SUPERFINE POWDERS

[75] Inventors: Anatoly F. Eremin; Evgeny L. Goldberg; Vladimir Y. Gololobov; Valentin I. Petrozhitsky; Vladimir V. Boldyrev, all of Novosibirsk, U.S.S.R.

[73] Assignee: Institut Khimii Tverdogo Tela I Pererabotki Mineralnogo Syrya Sibirskogo Otdelenia Akademii Nauk USSR, Novosibirsk, U.S.S.R.

[21] Appl. No.: 34,440

[22] Filed: Apr. 3, 1987

[51] Int. Cl.[4] ..... B07B 7/00

[52] U.S. Cl. ..... 209/143; 209/148

[58] Field of Search ..... 209/139.1, 139.2, 147–149, 209/143; 55/407, 408

[56] References Cited

U.S. PATENT DOCUMENTS

| | | | |
|---|---|---|---|
| 1,101,493 | 6/1914 | Houghton | 55/407 |
| 3,615,008 | 10/1971 | Alpha | 209/148 |
| 3,670,886 | 6/1972 | Hosokawa | 209/139.2 |
| 4,066,535 | 1/1978 | Strauss | 209/148 |
| 4,323,369 | 4/1982 | Monson | 55/406 |
| 4,388,183 | 6/1983 | Thomas | 209/139.2 |
| 4,560,471 | 12/1985 | Yamada | 209/148 |
| 4,689,140 | 8/1987 | Folsberg | 209/148 |

FOREIGN PATENT DOCUMENTS

| | | | |
|---|---|---|---|
| 145057 | 11/1949 | Australia | 209/139.2 |
| 220069 | 4/1958 | Australia | 209/148 |
| 352620 | 3/1920 | Fed. Rep. of Germany | 209/139.2 |
| 559834 | 9/1923 | France | 55/407 |
| 994057 | 2/1983 | U.S.S.R. | 209/148 |
| 798885 | 7/1958 | United Kingdom | 209/148 |

*Primary Examiner*—William L. Freeh

*Attorney, Agent, or Firm*—Burgess, Ryan & Wayne

[57] ABSTRACT

A characteristic feature of the design are the rounded off peripheral portions of surfaces of discs which face each other and are spaced equidistantly apart, the discs being rigidly attached to a power-driven rotor.

5 Claims, 2 Drawing Sheets

CENTRIFUGAL CLASSIFIER FOR SUPERFINE POWDERS

TECHNICAL FIELD

The present invention relates to methods of separating particulate material into fractions and has specific reference to centrifugal air classifiers the separating means whereof resort to the use of two opposing forces: centrifugal force and the force acting on a particle in a gas flow (the so-called Stokes' force). The invention may be of utility in processes where use is made of particulate material with a specified grading. It holds out special promise in microelectronics, in the manufacture of abrasives, ceramics and the like.

BACKGROUND OF THE INVENTION

There are known centrifugal classifiers of various types. One (cf. USSR Inventor's Certificate No. 740305, Cl. B07B, 7/083, 1980) has a housing contained wherein is a rotor with discs which whirl a gas/powder mixture as this passes through the so-called separation zone (a space where the material is separated into fractions) formed by the edges of the discs. The larger particles are separated there from the mixture and the fines leave the housing with the gas flow via a bore of the rotor and an outlet tube.

In the known classifiers, the separation zone is short and of ineffective spatial configuration. Therefore, the particles coming accidentally outside its limits are excluded from the process of separation, and not all the particulate material lends itself to whirling by the discs of the known design. Appreciable variations in particle size at the fraction border are unavoidable in this case, and particles of a size less than 5–10 μm are inseparable.

Also known is a classifier (cf. Patent of FRG No. 3303078, Cl. B07B 7/083, 1983) which incorporates a housing contained wherein is a rotor with coaxially attached discs linked to each other by blades which serve to whirl an air/powder mixture fed between the discs over an inlet tube of the housing. The outlet for the separated material is via a bore of the rotor and an outlet tube.

Here, the separation zone is even smaller than one described above, being confined only to the outside surface of the separating means, so that uncomfortably high rotor speeds of about 20000 rpm are required in order to separate particles with a size of 4–8 μm.

SUMMARY OF THE INVENTION

The main object of the invention is to provide a classifier capable of separating particles with a size of 1–2 μm.

Another object of the invention is to use low rotor speeds during the separation.

A further object of the invention is to ensure effective separation of the particles in the 1–2 μm fineness range from the larger particles.

One more object of the invention is to increase throughput capacity of the classifier.

These and other objects are realized by that in a centrifugal classifier for superfine powders having a housing which contains a power-driven rotor carrying a pair of discs coaxially and rigidly attached thereto and serving to whirl an air/powder mixture fed between the discs via an inlet tube of the housing and discharged from the space between the discs through a bore of the rotor and an outlet tube, wherein according to the invention peripheral portions of surfaces of the discs facing each other are rounded off and the rounded off portions of the two discs are spaced equidistantly apart.

It is expedient to provide an opening in a side wall of the housing next to the edge of the disc of a larger diameter for discharging the larger particles therethrough and to provide the disc of a smaller diameter with beaters for additional disaggregation of material being fed.

One of the embodiments of the classifiers provides on the side from which material is fed an additional disc rigidly mounted on the rotor coaxially with the main disc next to it and defining therewith a so-called material whirling zone an outlet from which is made in the form of a plurality of holes provided over the periphery of the main disc, said discs being arranged with a clearance relative to the last disc secured on the rotor and the housing being provided with an inlet tube to admit a portion of gas into said clearance.

These features of the design ensure quality separation of the fines, those in the 1–2 μm fineness range in particular.

The essence of the invention is that the rounded off peripheral portions of surfaces of the discs which face each other enable the gas carrying the particulate material to turn steadily in entering the space between the discs. The resultant of the two main forces coming into play in the centrifugal air classifier, Stokes' force and centrifugal one, is directed so that the particles of the material settle on the surface of just one of the revolving discs, on the concave one. The settling tendency of the particles is magnified by the "cyclone effect" of the turning gas flow. The settled particles acquire all the same rate of rotation. However, those in contact with the surface cease to be influenced by the Stokes' force (because of the effect of the so-called Poiseuille's contour) and are acted upon by the centrifugal force only which throws them back towards the entrance into the space between the discs, oppositely to the direction of gas flow. At the entrance, the gas flow takes over and returns the particles into the separation zone. In the course of such motions of the particles repeated in succession, the larger ones accumulate at the side wall of the housing wherefrom they are discharged via the side opening and the fines leave the separation zone and enter the space between the discs wherefrom they are discharged via the bore of the rotor and the outlet tube.

The rounded off peripheral portions of the discs spaced equidistantly apart, permitting the gas flow to enter the space between the discs turbulence-free, enhance the separating effect.

The side opening of limited size provided in the housing next to the edge of the disc with a larger diameter and serving as the outlet for the larger particles permits additional reprocessing thereof before discharge.

The beaters provided at the surface of one of the discs passing across which is the processed gas/powder mixture are intended to disintegrate aggregations of particles for better separation.

With the additional disc mounted on the rotor a material whirling zone is defined by surfaces of the additional and main discs facing each other. All particles of the material irrespective of their quantity passed through the peripheral holes of the main disc attain an equal peripheral velocity which certainly increases the throughput capacity of the classifier. To discharge coarse fraction making up a greater part of the processed material between the discs defining the whirling zone and the disc defining the material separation zone there is provided a clearance which ensures discharge of coarse particles irrespective of degree of increasing the classifier throughput capacity. To blow off a finer fraction from the coarse particles, a portion of gas is supplied to the clearance between the discs through an inlet tube provided in the housing in opposition to the flow of coarse particles.

The disclosed classifier can effectively separate particles in the 1–2 μm fineness range at a rotor speed of not over 5000 rpm. Its throughput capacity may vary between 0.4 and 5 kg/h depending on the adhesion and density of the particulate material.

BRIEF DESCRIPTION OF THE DRAWINGS

A preferred embodiment of the invention will now be described with reference to the accompanying drawings in which.

DESCRIPTION OF THE PREFERRED EMBODIMENT

Figure 1:
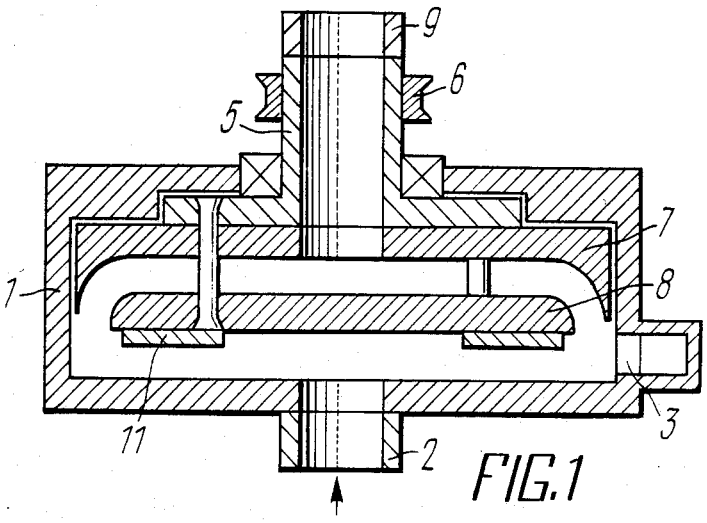
FIG. 1 is a sectional elevation of a centrifugal classifier according to the invention.

Referring to FIG. 1, a centrifugal classifier for superfine powders according to the invention comprises a cylindrical housing 1 with a tube 2 fed wherethrough is a gas/powder mixture and an opening 3 in the side wall of the housing 1 discharged wherethrough with the aid of a tube 4 (FIG. 2) are the larger particles. A rotor 5 (FIG. 1) with an external actuating means 6 is contained in the housing 1 along the axis thereof and is provided with two coaxially and rigidly attached discs 7 and 8. One of the discs with a larger diameter is located so with respect to the other disc that the space between the discs communicates with the inlet tube 2, the bore of the rotor 5 and with an outlet tube 9 discharged wherethrough are the fines and gas. A hopper 10 (FIG. 2) is provided at the end of the tube 4 accumulated wherein are the larger particles. The opening 3 (FIG. 1) in the side wall of the housing 1 is located next to the edge of the disc 7. Fitted to the surface of the disc 8 which faces the inlet tube 2 are beaters 11, and peripheral portions of surfaces of the discs 7 and 8 which face each other are rounded off and spaced equidistantly apart.

Figure 3:
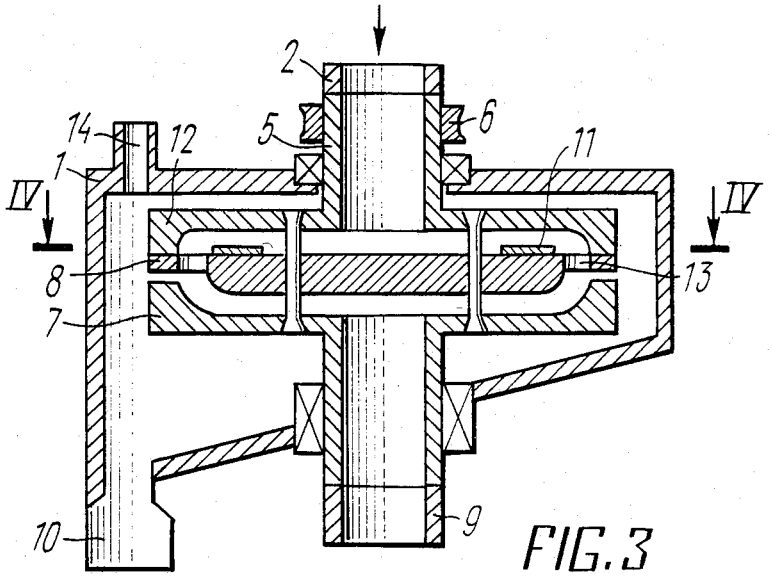
FIG. 3 shows an axial section of an embodiment of the classifier having three separating discs.
Figure 4:
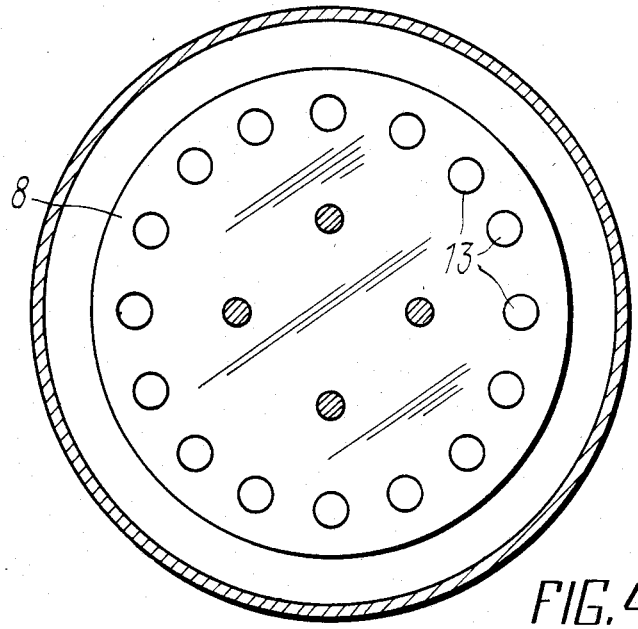
FIG. 4 is a section on the line IV—IV of FIG. 3.

FIG. 3 illustrates an embodiment of the classifier having an additional disc 12 mounted on the rotor 5 on the side from which material is fed. It is arranged coaxially with the main disc 8 next to it. The discs 12 and 8 define a so-called material whirling zone an outlet from which is made in the form of a plurality of holes 13 (FIG. 4) provided over the periphery of the disc 8. In this embodiment the discs 12 and 8 (FIG. 3) have the same diameter and edges rigidly fixed to one another. They are installed with a clearance relative to the disc 7 whose diameter is equal to that of the discs 12 and 8, and defined therewith a material separation zone. The housing 1 has an inlet tube 14 to admit a portion of gas into the clearance between the discs.

Figure 2:
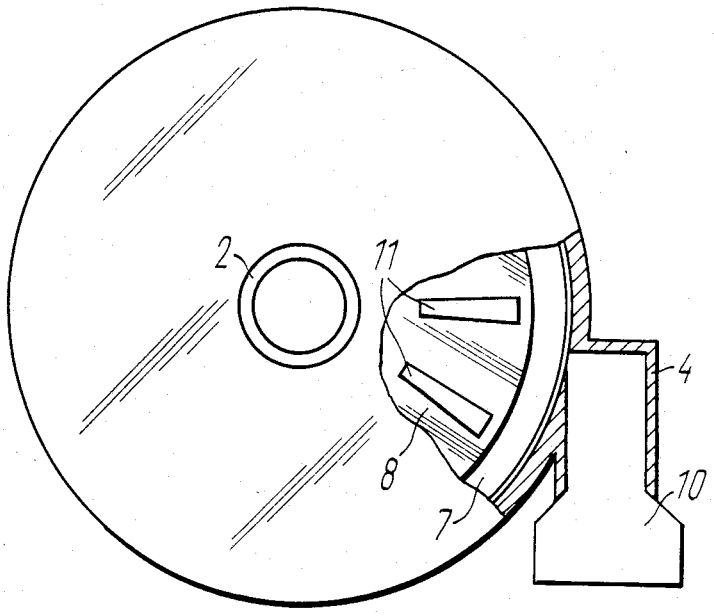
FIG. 2 shows a tube for discharging the larger particles.

The classifier illustrated in FIGS. 1 and 2 operates in the following way. The rotor is set rotating from the actuating means 6. A gas/powder mixture to be treated enters the housing 2 through the tube 2 and passes across the revolving disc 8 which imparts whirling motion to the mixture. The beaters 11 disintegrate aggregations of particles in the superfine particulate material which reaches then the separation zone formed by the rounded off portions of surfaces of the discs facing each other. In passing through the separation zone, the length whereof can be varied by changing the configuration of the peripheral portions of surfaces of the discs 8 and 7 facing each other, the material undergoes separation. For the larger particles, the centrifugal force set up in the classifier is greater than the force acting on a particle in the gas flow (Stokes' force). Therefore, the larger particles are thrown to the side wall of the housing 1 and are discharged therefrom through the side opening 3 and the tube 4 connecting to the hopper 10. The fines, acted upon by the Stokes' force which exceeds in this case the centrifugal one, are carried by the gas flow into the space between the discs and are discharged therefrom via the bore of the rotor 5 and the outlet tube 9.

The classifier shown in FIG. 3 operates in the following way. A superfine material carried by gas enters the whirling zone formed by the surfaces of the discs 12 and 8 facing each other and is additionally disaggregated by beaters 11. In the whirling zone all particles of the material having passed the holes 13 in the disc 8 attain the same peripheral velocity. The larger particles pass through the clearance between the discs directly to the housing 1; whereas the remaining material comes to the separation zone substantially defined by rounded off portions of the discs 8 and 7. The particles for which the centrifugal force exceeds Stokes' force move over the concave surface of the disc 7 and pass through the clearance between the discs to the housing. The fines carried away by the gas flow through the axial opening of the disc 7 are discharged through the tube 9. In their turn, portions of gas are admitted in parts through the inlet tube 14 into the housing. When passing through the clearance between the discs the gas blows off the fines from the going out coarse fraction and carries them through the tube 9. The coarse fraction accumulates in the hopper 10.

INDUSTRIAL APPLICABILITY

An extended separation zone of effective spatial configuration renders the classifier suitable for treating superfine particulate material, providing for the separation of particles as small as 1 or 2 μm at comparatively low rotor speeds.

What is claimed is:

1. A centrifugal classifier for superfine powders comprising:
   (1) a housing with a means for feeding a mixture of powder and gas to be treated;
   (2) a rotatable shaft in said housing;
   (3) a means for rotating said shaft;
   (4) a pair of coaxial discs rigidly fixed to said shaft with a fixed space therebetween, defined by a surface of each disc, to which the gas/powder mixture entering into the space therebetween, peripheral portions of the surfaces of said discs, which face each other to define the fixed space therebetween, are rounded off and spaced equidistantly apart; and
   (5) means for separately discharging larger particles and fines obtained by separation of said material.

2. A centrifugal classifier as claimed in claim 1, wherein on the side from which material is fed the rotor rigidly mounts an additional disc arranged coaxially with the main disc next to it and defining therewith a material whirling zone an outlet wherefrom is made in the form of a plurality of holes provided over the periphery of the main disc, said discs being arranged with a clearance relative to the last disc secured on the rotor and the housing being provided with an inlet tube to admit a portion of gas into said clearance.

3. A centrifugal classifier of claim 1 comprising two coaxial discs wherein the coaxial discs have different diameters.

4. A centrifugal classifier as claimed in claim 3, wherein an opening is provided in a side wall of said housing next to the edge of said disc with a greater diameter.

5. A centrifugal classifier of claim 3 wherein the smaller diameter disc is provided with beaters to disaggregate the material.

* * * * *